United States Patent [19]

Soriero, Jr.

[11] 3,955,801

[45] May 11, 1976

[54] PRE-FABRICATED FENCES

[75] Inventor: William Anthony Soriero, Jr., Hollywood, Fla.

[73] Assignee: Vinylife Industries, Hollywood, Fla.

[22] Filed: Aug. 1, 1975

[21] Appl. No.: 601,139

[52] U.S. Cl. ..... 256/65

[51] Int. Cl.[2] ..... E04H 17/14

[58] Field of Search ..... 256/65, 47, 1, 21, 19, 256/22, 24, 59; 403/252, 255, 254; 24/73 P, 206 A; 248/73, 223, 225

[56] References Cited

UNITED STATES PATENTS

| | | | |
|---|---|---|---|
| 3,747,965 | 7/1973 | Wing | 403/252 |
| 3,888,440 | 6/1975 | Rebentisch | 248/73 |
| 3,902,703 | 9/1975 | Bouye | 256/65 |

*Primary Examiner*—Paul R. Gilliam
*Assistant Examiner*—Doris L. Troutman
*Attorney, Agent, or Firm*—Arthur L. Plevy

[57] ABSTRACT

There is disclosed a pre-fabricated fence assembly which comprises a fence post having at least one rail accommodating slot. A rail is forced into the slot and is retained therein by means of a retainer clip which is secured to the rail and comprises a "D" shaped wedge member which is secured to the rail by means of two projections which are inserted into apertures in the rail prior to insertion of the composite rail and retainer member into the post aperture.

The post, rail and retainer members are preferably fabricated from a durable plastic material such as vinyl to afford reliable and long use when the fence is emplaced at a desired location.

10 Claims, 8 Drawing Figures

PRE-FABRICATED FENCES

BACKGROUND OF THE INVENTION

This invention relates to fences and more particularly to a pre-fabricated fence assembly which can be easily installed at a site.

The prior art is replete with a number of different fence configurations, each adapted to surround the boundaries of a property to enclose the same for designation of property lines or to enhance the aesthetic qualities of the property.

As such, many fences are fabricated from steel, wood and so on and are relatively difficult to install and further, require continuous maintenance as paintings, repair and so on.

The usual fence configurations require a substantial effort to install and hence, many entities are engaged in the fence installation business, as most fences are not capable of being installed by the average layman, such as the home owner.

It is therefore an object of this invention to provide an improved fence assembly which is pre-fabricated, easy to install and fabricated from a relatively maintenance free material such as vinyl plastic.

DESCRIPTION OF PREFERRED EMBODIMENT

A pre-fabricated fence assembly comprises a post member which is a longitudinal tubular cylinder having a rail accommodating slot on a surface thereof, a rail member has a cross section relatively congruent to said slot and has a clip member secured on a surface thereof for insertion into said slot, said clip member of a "D" shaped wedge configuration having at least one projection extending from a bottom surface thereof for insertion into an aperture on said surface of said rail member to retain the same to said rail member, said rail and wedge when inserted into said slot retained within the hollow confines of said post member due to a thickened end of said clip abutting against an inner surface of said post.

DETAILED DESCRIPTION OF FIGURES

Figure 1:
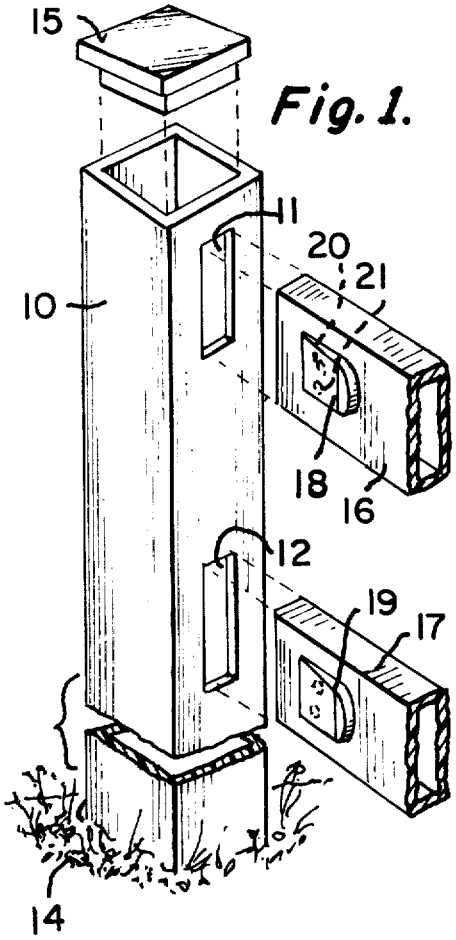
FIG. 1 is a perspective view of a rail and post assembly of a fence configuration according to this invention.

Referring to FIG. 1, there is shown a fence post 10. Basically, the fence post is a rectangular longitudinal cylinder fabricated from a vinyl plastic or some other durable, plastic material. As such, the post 10 will not be subjected to corrosion, attacking insects or require painting as do fences fabricated from other materials as steel or wood. A typical post assembly as 10 is fabricated by an extrusion process and hence, has no seams and is relatively an integral unit. As such, the post 10 can be accommodated for any height and relatively any dimensions as to width and so on can be achieved. Typically, the post 10 as fabricated from a vinyl plastic may be a square in cross section of 5 by 5 inches and have a wall thickness of about 0.090 inches. The height can vary according to the desires of a user.

Located on a side surface of the fence post 10 are two rail accommodating slots or apertures 11 and 12. While the slots 11 and 12 are shown as rectangular in shape, it is understood that any other shape can be accommodated as dependent upon the cross sectional configuration of a rail to be inserted and retained therein.

The post 10 is shown inserted into the ground and retained therein by means of concrete or otherwise. Any conventional technique for insertion of a post as 10 into the ground is anticipated and not considered to be part of the invention. A cover member or cap 15 is shown above the top opening in the post and is inserted therein and held by a force-fit or a glue or epoxy. The purpose of the cover member 15 is to prevent water and so on from entering the post after installation and to further enhance the appearance of the assembly.

Shown adjacent to the post are two rail members 16 and 17. The rail members 16 and 17 are also fabricated from a plastic material and typically may be 6 inches in height and 1½ inches thick. The cross section of the rail members 16 and 17 account for the shape of the slots 11 and 12 in the post 10. Secured to each rail member 16 and 17 at the left end, is a clip or retainer member as 18 and 19.

Both retainer members as 18 and 19 are fabricated from vinyl and have a top surface generally of an elongated "D" shaped configuration. The members have a wedged shaped side configuration and hence, taper in thickness from a slight thickness closest to the edge of the rail to a greater thickness near the rounded end of the "D" shaped member.

The retainer members are secured to the rails 16 and 17 by means of two projections on the undersurface as 20 and 21, which are forceably inserted into apertures located on the surface of the rail. As will be explained, the projections have a piercing or pointed front end allowing easy insertion into the apertures on the rails.

Once the retainer clips 19 and 20 are emplaced on the rail, the rail is forced into the apertures 11 and 12 of the post 10.

Since the vinyl is flexible, the wedge-shaped retainers will flex the edges about the apertures 11 and 12 and when the retainer as 19 or 20 is within the hollow confines of the post 10, the material about the apertures 11 and 12 will "spring back", thus securing the rail within the post 10.

Figure 2:
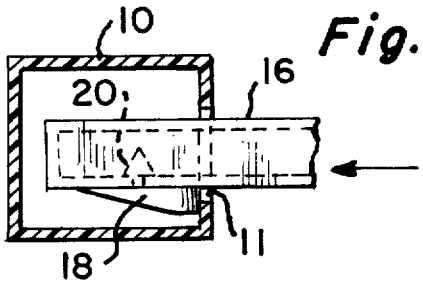
FIG. 2 is a top view of a fence rail and post assembly.

Referring to FIG. 2, there is shown a top view of the post 10 with the rail 16 and retainer 18 inserted therein.

As can be seen from FIG. 2, the rail 16 and retainer 18 are forced or pushed into the aperture 11 of the post. When the retainer 18 and the end portion of the rail 16 are within the hollow of the post 10, the edges of the post material about aperture 11, springs back and retains the rail assembly therein. One cannot easily remove the same, due to the side configuration of the wedge as having a thickened end which abuts against the inside surface of the post 10 about the aperture as 11.

Figure 3:
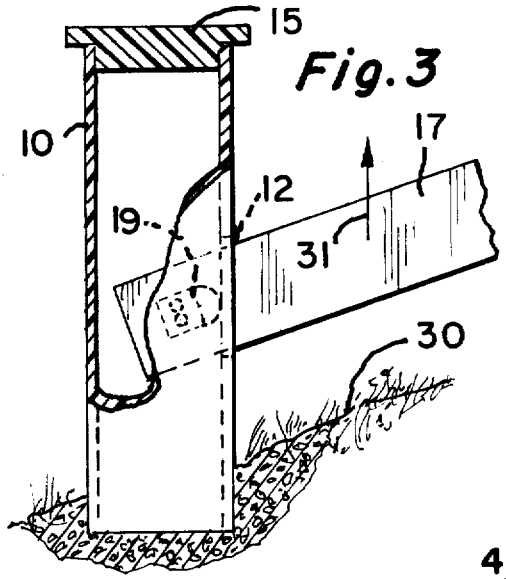
FIG. 3 is a cross sectional view of a rail secured to a fence post along an incline.

FIG. 3 shows a cross sectional view of a post 10 with a bottom rail as 17 of FIG. 1 emplaced within the aperture 12.

In FIG. 3, the fence assembly is to be emplaced along a property having an incline as 30. The rail 17, with the wedge 19 secured thereto, is inserted in the aperture 12 of the post 10 as above described.

As indicated, the wedge or retainer 19 is "D" shaped. The rounded edge of the wedge abuts against the inner surface of the post and allows the rail to pivot in the direction of arrow 31 to accommodate such inclines. One can reaily ascertain that if the retainers were rectangular or square, the end of the wedge would prevent such movement.

Figure 4:
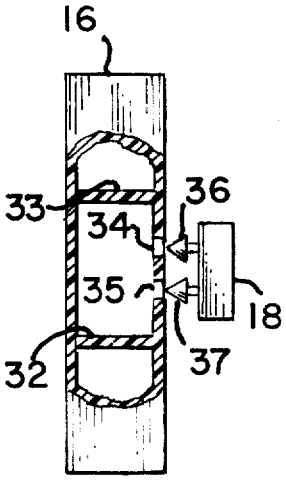
FIG. 4 is a side view of a rail and retainer clip member prior to coupling.

Referring to FIG. 4, there is shown a side view of a typical rail member as 16. The rail member 16 as indicated, is fabricated from a vinyl and has a series of rib like support members as 32,33 to afford strength and rigidity to the structure.

Typically, the rail may be six inches in height and about one and a half inches wide.

Figure 5:
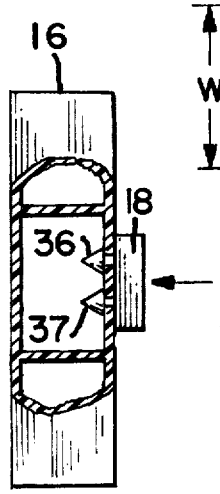
FIG. 5 is a side view of a composite rail and clip member.

Two holes 34 and 35 are drilled or pre-fabricated in a side of the rail. The retainer clip as 18 has two arrow like projections 36 and 37 extending from the bottom surface thereof. These projections are aligned with apertures 34 and 35 in the rail and the wedge assembly 18 is pushed towards the rail 16, thus securing the wedge retainer 18 to the rail 16 as shown in FIG. 5.

Figure 6:
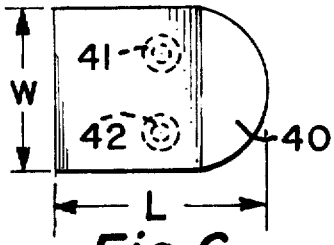
FIGS. 6, 7 and 8 are respectively top, bottom and side views of a retainer clip according to this invention.
Figure 7:
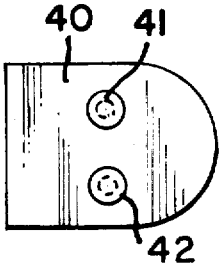
Figure 8:
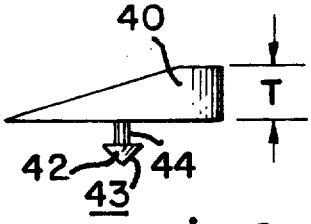

FIGS. 6, 7 and 8 are top, bottom and side views of a retainer clip as 18 or 19 of FIG. 1.

As can be seen from FIG. 6, the clip 40 is "D" shaped having a rounded surface at the thicker edge of the wedge to enable a rail to pivot when necessary. The projections as 41 and 42 are arrow like members integrally formed with the clip members and are best shown in FIG. 8. The flange formed between the arrow head 43 and the shaft 44 serve to hold the wedge 40 into the rail; due to the fact that the aperture drilled or formed in the rail is of a smaller diameter than the top portion of the arrow shaped end. The means of securing the wedge clip 40 to the rail is similar to the insertion of the rail and wedge into the post 10 and is afforded by the flexible nature of the plastic material used.

A typical clip used for a 6 inch wide rail may be of width W and length L (FIG. 6) of about 1 inch. The thickness T of the rounded end (FIG. 8) is about 3/16 of an inch. The wedge or clip 40 is integrally formed of a vinyl or other plastic although some other material may suffice as well.

The two projections as 41 and 42 are used to avoid rotation of the clip 40 when emplaced in the rail.

I claim:

1. A prefabricated fence assembly, comprising:

a. a post member relatively a longitudinal tubular cylinder having a slot along one surface thereof, said slot communicating with the internal hollow of said cylinder, b. a rail member having a cross sectional configuration relatively congruent with said slot in said post member, said rail member having at least one aperture in a side surface thereof near a front end of said rail, c. a clip member of a wedge shaped side configuration tapering from a narrow front end to a thicker second end, said clip member having an accommodating projection on a bottom surface thereof for insertion into said aperture of said rail to form a composite rail assembly for insertion into said slot of said post, said wedge shaped member retaining said rail in said post with said thicker end abutting against an inner surface of said post adjacent to said slot.

2. The fence assembly according to claim 1 wherein said post member is fabricated from a relatively flexible plastic material.

3. The fence assembly according to claim 1, wherein said rail member has another aperture located on the same surface as said least one aperture, and said clip member includes another projection on said bottom surface positioned to coact with said another aperture when said one aperture is aligned with said accommodating projection.

4. The fence assembly according to claim 1, wherein said clip member has a "D" shaped surface configuration with said thicker second end located at the rounded portion of said "D".

5. The fence assembly according to claim 1 wherein said projection on said bottom surface of said clip comprises a piercing assembly having a front shaped arrow portion contiguous with a shaft portion coupled to said bottom surface of said clip, said arrow portion having its diameter closest to said shaft larger than the diameter of said aperture in said rail.

6. The fence assembly according to claim 1 wherein said rail is generally a hollow rectangular cylinder having a plurality of supporting ribs within said hollow for strengthening the same.

7. The fence assembly according to claim 1 further including a cap member for covering a top opening of said post cylinder.

8. The fence assembly according to claim 6 wherein said rail member is fabricated from a vinyl plastic.

9. The fence assembly according to claim 3 wherein said apertures are colinear.

10. The fence assembly according to claim 1 wherein said clip member is fabricated from a vinyl plastic.

* * * * *